US005253629A

United States Patent [19]

Fornuto et al.

[11] Patent Number: 5,253,629

[45] Date of Patent: Oct. 19, 1993

[54] FLOW SENSOR FOR EVAPORATIVE CONTROL SYSTEM

[75] Inventors: Joseph Fornuto, Rochester; William E. Gifford, Hemlock; Karen M. Meyer, Avon; Otto Muller-Girard, Jr., Rochester, all of N.Y.; Harold M. Haskew, Milford, Mich.

[73] Assignee: General Motors Corporation, Detroit, Mich.

[21] Appl. No.: 829,829

[22] Filed: Feb. 3, 1992

[51] Int. Cl.[5] ..... F02M 33/02; F02B 77/02

[52] U.S. Cl. ..... 123/519; 123/198 D

[58] Field of Search ..... 123/198 D, 518, 519, 123/520, 521, 516

[56] References Cited

U.S. PATENT DOCUMENTS

| | | | |
|---|---|---|---|
| 3,418,987 | 12/1968 | Stoneburner | 123/520 |
| 4,703,736 | 11/1987 | Atkins | 123/519 |
| 4,846,135 | 7/1989 | Tiphaine | 123/518 |
| 5,088,466 | 2/1992 | Tada | 123/519 |

FOREIGN PATENT DOCUMENTS

| | | | |
|---|---|---|---|
| 0022628 | 2/1977 | Japan | 123/518 |
| 0044124 | 4/1979 | Japan | 123/519 |
| 0110853 | 7/1983 | Japan | 123/519 |
| 0220951 | 12/1983 | Japan | 123/519 |
| 0007962 | 1/1987 | Japan | 123/519 |
| 0125553 | 5/1989 | Japan | 123/519 |

*Primary Examiner*—Carl S. Miller

*Attorney, Agent, or Firm*—Charles K. Veenstra

[57] ABSTRACT

A device for detecting a malfunction of the evaporative control system comprises a two-way flow device in the atmospheric air vent of the evaporative canister with a sensor to detect whether fluid is flowing through the canister during selected operating conditions.

8 Claims, 2 Drawing Sheets

FLOW SENSOR FOR EVAPORATIVE CONTROL SYSTEM

TECHNICAL FIELD

The present invention relates to a device for detecting malfunctions of a fuel evaporative control system, and specifically to a valve assembly device having the capability of detecting the flow of atmospheric air into the evaporative canister without interfering with the flow of fuel vapors into the evaporative canister.

BACKGROUND OF THE INVENTION

In the current conventional fuel evaporative control system, an operator of a vehicle is not aware if there is a malfunction in the purging process, whereby fuel vapors stored in the canister are not being purged into the engine induction system. Therefore, the only means to determine a malfunction is a visual inspection of the evaporative control system. If the canister is not purged, it will become saturated and fuel vapors that would normally be adsorbed by the adsorbent in the canister will be emitted into the atmosphere.

U.S. Pat. No. 4,962,744 issued Oct. 16, 1990 to Kouji Uranishi et. al. shows a method to detect a malfunction in the evaporative control system. It monitors the temperature inside the evaporative canister and then calculates the change in temperature when adsorbing and purging fuel vapor. U.S. Pat. No. 4,949,695 issued Aug. 21, 1990 to Kouji Uranishi et. al. is another method to detect a malfunction by comparing the pressure in the fill and/or purge passage with that of the pressure in the intake vacuum.

SUMMARY OF THE INVENTION

The present invention provides an improved means for detecting a malfunction during the fill and/or purge of the canister in the evaporative control system with minimal change of existing components. With this invention, a two-way flow device is situated in the atmospheric air vent of the evaporative canister. The device contains dual spring valves which are both biased closed, but oppositely configured from each other. One spring valve (denoted as A) is configured to be closed during periods when the vehicle is parked with the engine off, called a soak. This keeps one passageway from the air inlet to the canister closed The other spring valve (denoted as B) will open during the soak when the pressure in the fuel tank and canister increases. When spring valve B opens this allows air in the canister to escape into the atmosphere and fuel vapors to enter the canister. If spring valve B fails to open during preselected conditions, a sensor, such as a magnetic proximity sensor, that is sensitive to the movement of the spring valve can signal a malfunction to the driver.

During selected engine operations, the vacuum from the induction system will open spring valve A to allow fresh air into the flow device and then into the canister. Spring valve B will be closed during such operation. During selected operating conditions, the air flow through the two-way flow device can be determined by means of a sensor, such as a magnetic proximity sensor, that is sensitive to the movement of the spring valve A. If spring valve A is not open at these selected operating conditions, a malfunction signal can be given to the driver.

By installing the two-way flow device of the current invention in the air vent to the canister, and providing sensors that monitor movement of the valves, this device can detect malfunctions during the fill and purge of the canister in the evaporative control system while not interfering with fuel vapor flow to the canister.

The details of two embodiments of this invention are set forth in the remainder of the specification and are shown in the drawings.

DETAILED DESCRIPTION

Figure 1:
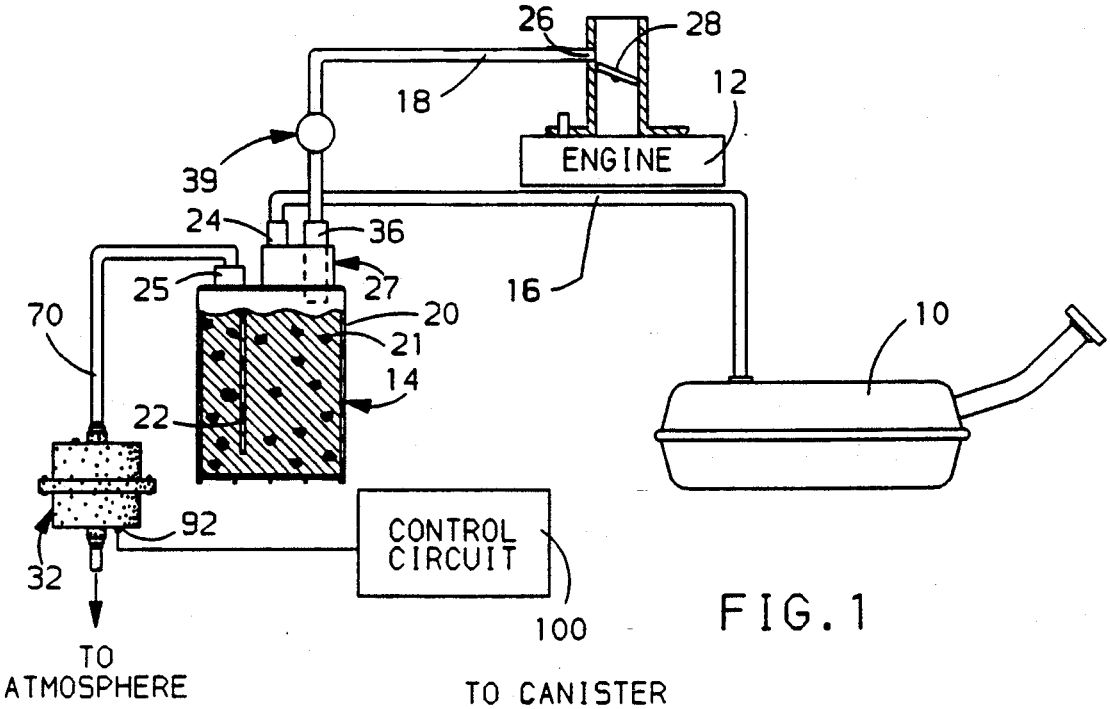
FIG. 1 is a schematic view of a fuel evaporative control system having a two-way flow device in the canister air vent in accordance with the invention.

In FIG. 1 the embodiment of the system comprises a fuel tank 10, and a vehicle engine 12, connected to the canister 14 by conduits 16 and 18 respectively. As the pressure of the air-fuel vapor formed in tank 10 increases, the vapor is vented to canister 14 through conduit 16 where the fuel vapor component is stored. A schematic of a typical canister is shown in FIG. 1. Canister 14 has a molded plastic exterior housing 20 which encloses an interior volume, charged with activated carbon granules 21, or the like, which are capable of adsorbing the fuel portion of the air-fuel vapor that is fed through canister 14. The interior volume of the canister has a partition 22 which improves vapor adsorption and purge rate. The air-fuel vapor enters the canister 14 through inlet fitting 24. The fuel vapor is adsorbed by the carbon granules 21, while the air continues around the partition 22 and passes through the air inlet 25. A liquid trap assembly 27 may also be added to the canister 14.

During engine operation when the port 26 is subject to the vacuum conditions below the throttle blade 28, vacuum applied through conduit 18 to aperture 36 induces air flow through the two-way device 32, and into canister 14 to desorb the stored fuel vapors and send them back to the engine intake. (The two-way device 32 is explained further below.) The air flow passes through conduit 70 and enters canister 14 through inlet 25. It flows through canister 14 while capturing fuel vapor. A purge solenoid 39 normally closed when the engine is not running may be operated to control the vapor flow through conduit 18 to the intake of the engine.

Figure 2:
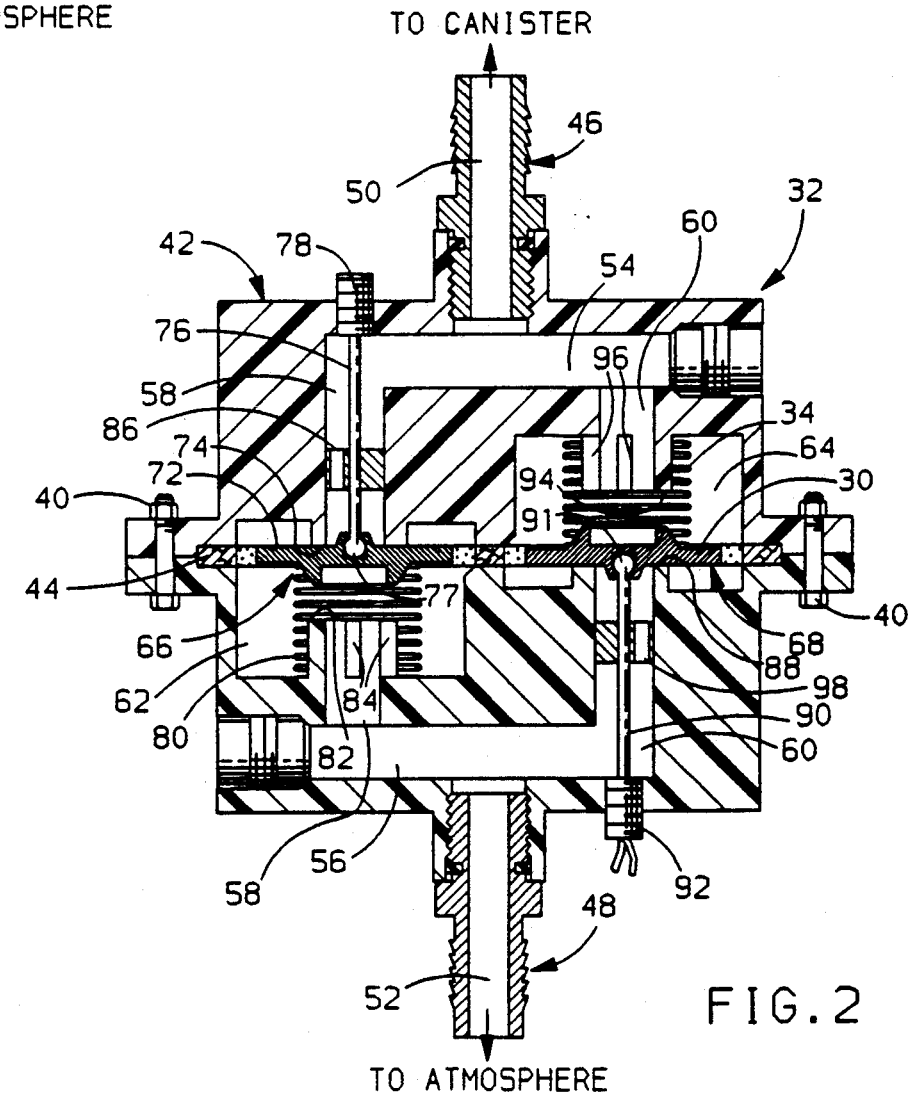
FIG. 2 is an enlarged sectional view of the two-way flow device showing one embodiment of the invention at rest.

FIG. 2 more fully shows the two-way flow device 32, which is constructed of two pieces of molded material such as plastic, that are bonded together by fastening means 40 to form a housing 42. The fastening means 40 can be replaced by a snap fit, a band clamp, or welding. A formed gasket 44 is sandwiched between the two pieces to prevent leakage.

The device 32 includes two tubular fittings 46 and 48 that may be threaded or integrated with the housing 42, with two apertures 50 and 52, two transverse passages 54 and 56 that communicate with two longitudinal passages 58 and 60. Within each longitudinal passage is a valve chamber 62 and 64 containing a check valve 66 and 68 respectively.

The housing 42 is adapted to be connected to conduit 70 by tubular fitting 46 having an aperture 50 which opens into the upper transverse passage 54. The check valve 66 comprises a valve member 72 in position for movement between open and closed positions relative to a valve seat 74. A magnetic stainless steel valve shaft 76 extends axially within the longitudinal passage 58. It is secured to the valve member 72 at one end, and is received in a plug 78 in the housing 42 at the other. A lightly loaded (1-10 inches water) coil spring 80 has one end in abutment against the inner surface of the valve chamber 62 and its opposite end in abutment against the valve member 72. The bias of the spring 80 is preselected, taking into consideration the area of the valve member 72 exposed to pressure in the upper portion of passage 58, so that as the pressure rises above atmospheric, the valve member 72 will be moved away from the valve seat 74 to a stop member 82. The stop member 82 is defined by a surface at the end of a cylindrical projection formed as a part of the housing section 42; the projection includes radial slots 84 to permit the fluid in chamber 62 to flow through the lower portion of longitudinal passage 58 and lower transverse passage 56 through the aperture 52 to atmosphere. This allows air-fuel vapors in the fuel tank 10 to flow through conduit 16. The fuel vapors will be adsorbed in the canister 14. The air will pass through the canister 14 and conduit 70 to the two-way device 32. As the valve member 72 moves in response to pressure, the valve shaft 76 moves concurrently. The valve shaft 76 is guided within the longitudinal passage 58 by a cylindrical bearing 86 fitted into passage 58.

The valve shaft 76 is secured to the valve member 72 by a swivel connection 77 that is machined on the valve shaft 76. The swivel connection 77 allows a much closer fit between the bearing 86 and the valve shaft 76. It also allows the valve member 72 to seat properly if the valve shaft 76 is not exactly perpendicular to the valve seat 74.

The check valve 68 is similar to the check valve 66. The check valve 68 comprises a valve member 30 in position for movement between open and closed positions relative to a valve seat 88. A magnetic stainless steel valve shaft 90 extends axially within the longitudinal passage 60. It is secured to the valve member 30 at one end, and is received by a sensor 92 at the other. A lightly loaded coil spring 34 has one end in abutment against the inner surface of the valve chamber 64 and its opposite end in abutment against the valve member 30. The bias of the spring 34 is preselected, taking into consideration the area of valve member 30 exposed to vacuum (sub-atmospheric pressure) in chamber 64, so that when the absolute pressure decreases below atmospheric pressure, the valve member 30 will be moved away from the valve seat 88 to a stop member 94. The stop member 94 is defined by a surface at the end of a cylindrical projection formed as a part of the housing section 42; the projection includes radial slots 96 to permit air to flow from the chamber 64, through the upper portion of longitudinal passage 60 and upper transverse passage 54 through the aperture 50 to the canister 14. The air purges the canister 14 of fuel vapor and carries the vapor through conduit 18 to the intake system of the engine 12. As the valve member 30 moves in response to vacuum, the valve shaft 90 moves concurrently. The valve shaft 90 is guided in place within the longitudinal passage 60 by a cylindrical bearing 98 fitted into passage 60.

The valve shaft 90 is secured to the valve member 30 by a swivel connection 91 that is machined on the valve shaft 90. The swivel connection 91 allows a much closer fit between the bearing 98 and the valve shaft 90. It also allows the valve member 30 to seat properly if the valve shaft 90 is not exactly perpendicular to the valve seat 88.

Sensor 92 is of a type that would present no hazard in explosive surroundings, such as a magnetic proximity sensor. The sensor 92 detects movement of the magnetic steel valve shaft 90 as it moves concurrently with the valve member 30 in response to vacuum and communicates that information to the control circuit 100 of the vehicle.

Figure 3:
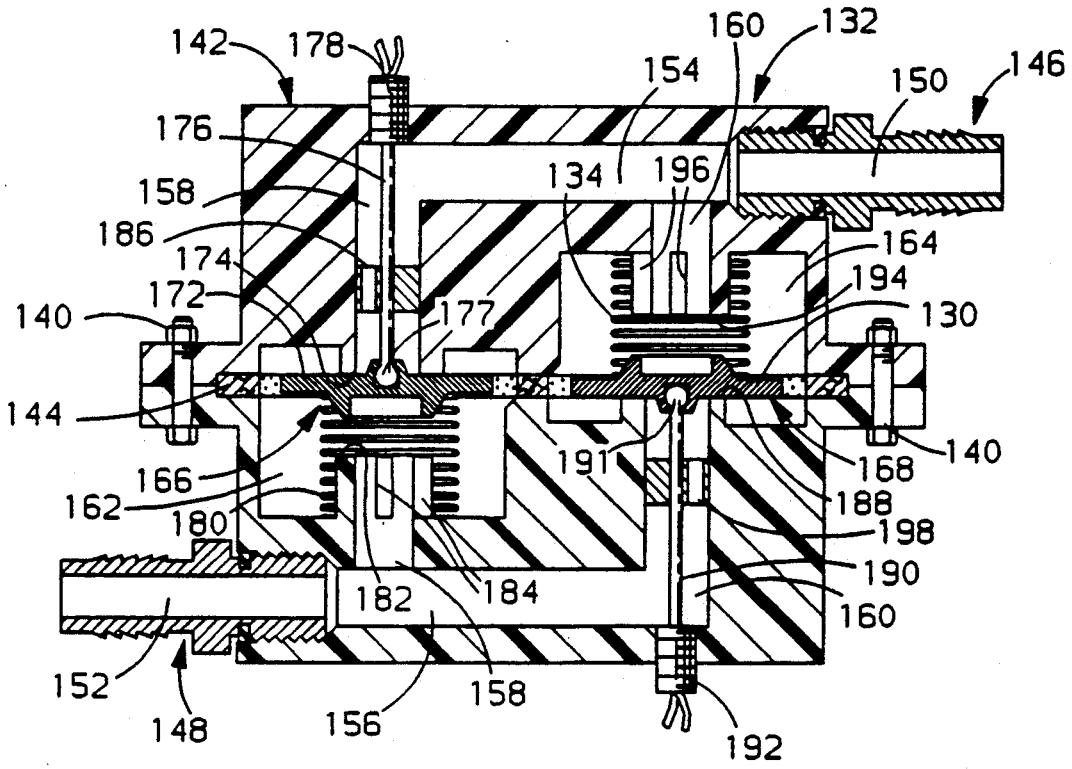
FIG. 3 is a modification of the two-way flow device of FIG. 2.

Referring to FIG. 3, the two-way flow device 132 is constructed of two pieces of molded material, such as plastic, that are bonded together by fastening means 140 to form a housing 142. The fastening means 140 can be replaced by a snap fit, a band clamp, or welding. A formed gasket 144 is sandwiched between the two pieces to prevent leakage.

The device 132 includes two tubular fittings 146 and 148 that may be threaded or integrated with the housing 142, with two apertures 150 and 152, two transverse passages 154 and 156 that communicate with two longitudinal passages 158 and 160. Within each longitudinal passage is a valve chamber 162 and 164 containing a check valve 166 and 168 respectively.

The housing 142 is adapted to be connected to conduit 70 by tubular fitting 146 having aperture 150 which opens axially into the upper transverse passage 154. The check valve 166 comprises a valve member 172 in position for movement between open and closed positions relative to a valve seat 174. A magnetic stainless steel valve shaft 176 extends axially within the longitudinal passage 158. It is secured to the valve member 172 at one end, and is received in a sensor 178 in the housing 142 at the other. A lightly loaded (1-10 inches water) coil spring 180 has one end in abutment against the inner surface of the valve chamber 162 and its opposite end in abutment against the valve member 172. The bias of the spring 180 is preselected, taking into consideration the area of the valve member 172 exposed to pressure in the upper portion of passage 158, so that as the pressure rises above atmospheric, the valve member 172 will be moved away from the valve seat 174 to a stop member 182. The stop member 182 is defined by a surface at the end of a cylindrical projection formed as a part of the housing section 142; the projection includes radial slots 184 to permit the fluid in chamber 162 to flow through the lower portion of longitudinal passage 158 and lower transverse passage 156 through the aperture 152 to atmosphere. This allows air-fuel vapors in the fuel tank 10 to flow through conduit 16. The fuel vapors will be adsorbed in the canister 14. The air will pass through the canister 14, through conduit 70 to the two-way device 132. As the valve member 172 moves in response to vacuum, the valve shaft 176 moves concurrently The valve shaft 176 is guided within the longitudinal passage 158 by a cylindrical bearing 186 fitted into passage 158.

The valve shaft 176 is secured to the valve member 172 by a swivel connection 177 that is machined on the valve shaft 176. The swivel connection 177 allows a much closer fit between the bearing 186 and the valve shaft 176. It also allows the valve member 172 to seat properly if the valve shaft 176 is not exactly perpendicular to the valve seat 174.

Sensor 178 is of a type that would present no hazard in explosive surroundings, such as a magnetic proximity sensor. The sensor 178 detects movement of the steel valve shaft 176 as it moves concurrently with the valve member 172 in response to pressure and communicates that information to the control circuit 100 of the vehicle.

The check valve 168 is similar to the check valve 166. The check valve 168 comprises a valve member 130 in position for movement between open and closed positions relative to a valve seat 188. A stainless steel valve shaft 190 extends axially within the longitudinal passage 160. It is secured to the valve member 130 at one end, and is received in sensor 192 at the other. A lightly loaded coil spring 134 has one end in abutment against the inner surface of the valve chamber 164 and its opposite end in abutment against the valve member 130. The bias of the spring 134 is preselected, taking into consideration the area of valve member 130 exposed to vacuum in chamber 164, so that when the absolute pressure decreases below atmospheric pressure, the valve member 130 will be moved away from the valve seat 188 to a stop member 194. The stop member 194 is defined by a surface at the end of a cylindrical projection formed as a part of the housing section 142; the projection includes radial slots 196 to permit air to flow from the chamber 164, through the upper portion of longitudinal passage 160 and upper transverse passage 154 through the aperture 150 to the canister 14. The air purges the canister 14 of fuel vapor and carries the vapor through conduit 18 to the intake system of the engine 12. As the valve member 130 moves in response to vacuum, the valve shaft 190 moves concurrently. The magnetic stainless steel valve shaft 190 is guided in place within the longitudinal passage 160 by a cylindrical bearing 198 fitted into passage 160.

The valve shaft 190 is secured to the valve member 130 by a swivel connection 191 that is machined on the valve shaft 190. The swivel connection 191 allows a much closer fit between the bearing 198 and the valve shaft 190. It also allows the valve member 130 to seat properly if the valve shaft 190 is not exactly perpendicular to the valve seat 188.

Sensor 192, may be a magnetic proximity sensor, that detects movement of the steel valve shaft 190 as it moves concurrently with the valve member 130 in response to vacuum and communicates that information to the control circuit 100 of the vehicle.

When the fuel evaporative control system is in working order, during the purge condition of the system, atmospheric air will flow through the two-way device 32 or 132. The air will then pass through the canister 14, purging any trapped vapors in the adsorbent particles 21 and sending them to the engine 12.

If the canister 14 is plugged or otherwise non-functional, or if there is a break in the conduit 18 between the canister 14 and the engine 12, vacuum from the engine 12 will not be communicated to the two-way flow device 32 or 132. Therefore, the valve member 30 or 130 will remain seated and not allow atmospheric air to enter the canister 14 to purge the fuel vapors and return them back to the engine 12. The control circuit 100 of the vehicle may be programmed to periodically check whether the two-way flow device 32 or 132 is open to allow atmospheric air through it by checking whether there is movement of the shaft 90 or 190 by means of the magnetic sensor 92 or 192. Therefore, according to the present invention, it is possible to quickly and precisely diagnose whether or not the purge condition of the fuel evaporative control system is malfunctioning.

If the canister 14 is plugged or otherwise non-functional, or if there is a break in the conduit 16 between the canister 14 and the fuel tank 10, pressure from the fuel tank 10 will not be communicated to the two-way flow device 32 or 132. Therefore, the valve member 72 or 172 will remain seated and not allow air-fuel vapors to enter the canister 14 to adsorb the fuel vapors. The control circuit 100 of the vehicle may be programmed to periodically check whether the two-way flow device 32 or 132 is open to allow air through it by checking whether there is movement of the shaft 76 or 176 by means of the magnetic sensor 92 or 192. Therefore, according to the present invention, it is possible to diagnose whether or not the fill condition of the fuel evaporative control system is malfunctioning.

During conditions when the evaporative control system is neither filling nor purging the canister, the valve members in the two-way flow device 32 or 132 are not under a pressure or vacuum influence, and therefore remain closed. During these conditions the two-way flow device 32 or 132 functions to prevent fuel vapors in the canister 14 from escaping into the atmosphere. Over a period of time fuel vapors that have been adsorbed in the canister 14 tend to migrate through the air inlet 25. Since the fuel vapors can not get beyond the valve members in the two-way flow device 32 or 132, the vapors will not enter the atmosphere.

The embodiments of the invention in which an exclusive property or privilege is claimed are defined as follows:

1. In a fuel evaporative control system having a canister for adsorbing fuel vapor evaporated from a fuel tank, said canister having an opening to the fuel tank, an opening to the atmosphere, and an opening to a vacuum source for an engine, the improvement comprising a flow device for detecting a malfunction of said fuel evaporative control system comprising:

a housing having two valve chambers, located in the opening from the canister to atmosphere, and having two apertures for flow into and out of said valve chambers, one of said apertures opening to atmosphere, and the second of said apertures opening to the canister, and said valve chambers each having a check valve comprising a valve seat, a valve member engageable with the valve seat, and a valve spring urging the valve member against the valve seat to inhibit flow through the valve chamber, wherein the first valve member opens in response to pressure conditions in said second aperture to permit fluid flow from the fuel tank through the canister and the first valve chamber, and the second valve member opens in response to vacuum conditions in said second aperture to permit flow of air through the second valve chamber and canister, and wherein said flow device includes a means to detect movement of at least one of said valve members.

2. In a fuel evaporative control system having a canister for adsorbing fuel vapor evaporated from a fuel tank, said canister having an opening to the fuel tank, an opening to the atmosphere, and an opening to a vacuum source for an engine, the improvement comprising a flow device for detecting a malfunction of said fuel evaporative control system comprising:

a housing having two valve chambers, located in the opening from the canister to atmosphere, and having two apertures for flow into and out of said valve chambers, one of said apertures opening to atmosphere, and the second of said apertures opening to the canister, and said valve chambers being adjacent to each other in longitudinal passages, said housing also having transverse passages that communicate with upper and lower ends of the longitudinal passages, and the upper transverse passage also communicating with said aperture opening to the canister and the lower transverse passage communicating with said aperture opening to the atmosphere, and each valve chamber having a check valve comprising a valve seat, a valve member engageable with the valve seat, and a valve spring urging the valve member against the valve seat to inhibit flow through the valve chamber, wherein the first valve member opens in response to pressure conditions in said second aperture to permit fluid flow from the fuel tank through the canister and the first valve chamber, and the second valve member opens in response to vacuum conditions in said second aperture to permit flow of air through the second valve chamber and canister, and wherein said flow device includes a means to detect movement of at least one of said valve members.

3. In a fuel evaporative control system having a canister for adsorbing fuel vapor evaporated from a fuel tank, said canister having an opening to the fuel tank, an opening to the atmosphere, and an opening to a vacuum source for an engine, the improvement comprising a flow device for detecting a malfunction of said fuel evaporative control system comprising:

a housing having two valve chambers, located in the opening from the canister to atmosphere, and having two apertures for flow into and out of said valve chambers, one of said apertures opening to atmosphere, and the second of said apertures opening to the canister, and said valve chambers being adjacent to each other in longitudinal passages said housing having transverse passages that communicate with upper and lower ends of the longitudinal passages, and the upper transverse passage also communicating with said aperture opening to the canister and the lower transverse passage communicating with said aperture opening to the atmosphere, and each valve chamber having a check valve comprising a valve seat, a valve member engageable with the valve seat, a valve spring urging the valve member against the valve seat to inhibit flow through the valve chamber, and a stop member against which the first valve member abuts when in the open position in response to pressure conditions in said second aperture thereby permitting fluid from the fuel tank to flow through the canister and around the first valve member, and a stop member against which the second valve member abuts when in the open position in response to vacuum conditions in said second aperture thereby permitting air flow from the atmosphere to flow around the second valve member and through the canister, and wherein said flow device includes means to detect movement of said valve members.

4. In a fuel evaporative control system having a canister for adsorbing fuel vapor evaporated from a fuel tank, said canister having an opening to the fuel tank, an opening to the atmosphere, and an opening to a vacuum source for an engine, the improvement comprising a flow device for detecting a malfunction of said fuel evaporative control system comprising:

a housing having two valve chambers, located in the opening from the canister to atmosphere, and having two apertures for flow into and out of said valve chambers, one of said apertures opening to atmosphere, and the second of said apertures opening to the canister, said valve chambers each having a check valve comprising a valve seat, a valve member engageable with the valve seat, and a valve spring urging the valve member against the valve seat to inhibit flow through the valve chamber, wherein the first valve member opens in response to pressure conditions in said second aperture to permit fluid flow from the fuel tank through the canister and the first valve chamber, and the second valve member opens in response to vacuum conditions in said second aperture to permit flow of air through the second valve chamber and canister, and wherein said second valve member is guided by a shaft that communicates with a sensor that can detect movement of said shaft and thereby detect a malfunction of the fuel evaporative control system

5. In a fuel evaporative control system having a canister for adsorbing fuel vapor evaporated from a fuel tank, said canister having an opening to the fuel tank, an opening to the atmosphere, and an opening to a vacuum source for an engine, the improvement comprising a flow device for detecting a malfunction of said fuel evaporative control system comprising:

a housing having two valve chambers, located in the opening from the canister to atmosphere, and having two apertures for flow into and out of said valve chambers, one of said apertures opening to atmosphere, and the second of said apertures opening to the canister, said valve chambers each having a check valve comprising a valve seat, a valve member engageable with the valve seat, and a valve spring urging the valve member against the valve seat to inhibit flow through the valve chamber, wherein the first valve member opens in response to pressure conditions in said second aperture to permit fluid flow from the fuel tank through the canister and the first valve chamber, wherein said first valve member is guided by a steel shaft which communicates with a magnetic proximity sensor that can detect movement of said shaft, wherein the second valve member opens in response to vacuum conditions in said second aperture to permit flow of air through the second valve chamber and canister, and wherein said second valve member is guided by a second steel shaft which communicates with a magnetic proximity sensor that can detect movement of said second shaft, whereby said flow device detects malfunctions of the fuel evaporative control system.

6. In a fuel evaporative control system having a canister for adsorbing fuel vapor evaporated from a fuel tank, said canister having an opening, to the fuel tank, an opening to the atmosphere, and an opening to a vacuum source for an engine, the improvement comprising a flow device for detecting a malfunction of said fuel evaporative control system comprising:

a housing having two valve chambers, located in the opening from the canister to atmosphere, and having two apertures for flow into and out of said valve chambers, one of said apertures opening to atmosphere, and the second of said apertures opening to the canister, said valve chambers being adjacent to each other in longitudinal passages, said housing having transverse passages that communicate with upper and lower longitudinal passages, and the upper transverse passage also communicating with said aperture opening to the canister and lower transverse passage communicating with said aperture opening to the atmosphere, and each valve chamber having a check valve comprising a valve seat, a valve member engageable with the valve seat, and a valve spring urging the valve member against the valve seat to inhibit air flow through the valve chamber, and a stop member against which the first valve member abuts when in the open position in response to pressure conditions in said second aperture thereby permitting fluid from the fuel tank to flow through the canister and around the first valve member, and a stop member against which the second valve member abuts when in the open position in response to vacuum conditions in said second aperture thereby permitting air flow from the atmosphere to flow around the second valve member and canister, and wherein said second valve member is guided by a steel shaft that communicates with a magnetic proximity sensor that can detect movement of the shaft and thereby detect a malfunction of the fuel evaporative control system.

7. In a fuel evaporative control system having a canister for adsorbing fuel vapor evaporated from a fuel tank, said canister having an opening to the fuel tank, an opening to the atmosphere, and an opening to a vacuum source for an engine, the improvement comprising a flow device for detecting a malfunction of said fuel evaporative control system comprising:

a housing having two valve chambers, located in the opening from the canister to atmosphere, and having two apertures for flow into and out of said valve chambers, one of said apertures opening to atmosphere, and the second of said apertures opening to the canister, said valve chambers being adjacent to each other in longitudinal passages, said housing having transverse passages that communicate with upper and lower longitudinal passages, and the upper transverse passage also communicating with said aperture opening to the canister and lower transverse passage communicating with said aperture opening to the atmosphere, and each valve chamber having a check valve comprising a valve seat, a valve member engageable with the valve seat, and a valve spring urging the valve member against the valve seat to inhibit air flow through the valve chamber, and a stop member against which the first valve member abuts when in the open position in response to pressure conditions in said second aperture thereby permitting fluid from the fuel tank to flow through the canister and around the first valve member, and wherein said first valve member is guided by a steel shaft that communicates with a magnetic proximity sensor that can detect movement of the shaft, and a stop member against which the second valve member abuts when in the open position in response to vacuum conditions in said second aperture thereby permitting air flow from the atmosphere to flow around the second valve member and through the canister, and wherein said second valve member is guided by a second steel shaft that communicates with a magnetic proximity sensor that can detect movement of the second shaft, whereby the flow device detects malfunctions of the fuel evaporative control system and transmits that information to a control system.

8. In a fuel evaporative control system having a canister for adsorbing fuel vapor evaporated from a fuel tank, said canister having an opening to the fuel tank, an opening to the atmosphere, and an opening to a vacuum source for an engine, the improvement comprising a flow device for detecting a malfunction of said fuel evaporative control system comprising:

a housing located in the opening from the canister to atmosphere, and having a valve chamber and two apertures for flow into and out of said valve chamber, the first of said apertures opening to atmosphere, and the second of said apertures opening to the canister, said valve chamber having a valve member, said valve member being sensitive to change in pressure within the two apertures, whereby said valve member moves in response to a difference in pressure conditions between said second aperture and said first aperture to permit air flow through said valve chamber, and wherein said flow device includes means to detect movement of said valve member, whereby a malfunction of said fuel evaporative control system is detected when no movement of said valve member is detected.

* * * * *